United States Patent [19]

Nevalainen et al.

[11] Patent Number: 4,637,240

[45] Date of Patent: Jan. 20, 1987

[54] CYLINDER LOCK

[75] Inventors: Kyösti Nevalainen; Kaarlo Martikainen, both of Joensuu, Finland

[73] Assignee: Oy Wärtsilä Ab, Helsinki, Finland

[21] Appl. No.: 749,084

[22] Filed: Jun. 25, 1985

[30] Foreign Application Priority Data

Jul. 10, 1984 [FI] Finland ..... 842749

[51] Int. Cl.[4] ..... E05B 29/04

[52] U.S. Cl. ..... 70/366; 70/377; 70/382; 70/384

[58] Field of Search ..... 70/382, 385, 377, 392, 70/366, 365, 376, 383, 384

[56] References Cited

U.S. PATENT DOCUMENTS

| | | | |
|---|---|---|---|
| 799,666 | 9/1905 | Oleschak | 70/376 |
| 3,555,859 | 1/1971 | Berkowitz | 70/377 X |
| 3,789,638 | 2/1974 | Roberts et al. | 70/366 |
| 4,008,588 | 2/1977 | Miller et al. | 70/366 |
| 4,083,212 | 4/1978 | Proefrock | 70/366 |
| 4,292,823 | 10/1981 | Reinhard et al. | 70/377 X |
| 4,326,396 | 4/1982 | Steinbach | 70/377 X |
| 4,351,172 | 9/1982 | Martikainen | 70/402 X |
| 4,418,555 | 12/1983 | Uyeda | 70/366 |
| 4,512,166 | 4/1985 | Dunphy et al. | 70/366 |

FOREIGN PATENT DOCUMENTS

| | | | |
|---|---|---|---|
| 22393 | 4/1948 | Finland | 70/365 |
| 115282 | 10/1945 | Sweden | 70/366 |
| 0592951 | 2/1978 | U.S.S.R. | 70/366 |

*Primary Examiner*—Robert L. Wolfe
*Assistant Examiner*—Lloyd A. Gall
*Attorney, Agent, or Firm*—Dellett, Smith-Hill and Bedell

[57] ABSTRACT

The invention relates to a cylinder lock including a number of locking discs (4) turnable by means of the key (8) of the lock and separated from each other by intermediate discs (5) and provided with a key opening (6) and with a peripheral notch (7), and a locking bar (3) which, when the lock is in the locking position, prevents turning of the set of discs and force transmission from the key (8). According to the invention the peripheral notches (7) of the locking discs are located so that the locking discs (4) are placeable in the set of discs in either way with regard to their plane, and at least some of the locking discs (4) are formed so that a surface (6*a*) of the key opening (6) of the locking disc co-operating with the corresponding combination surface of the key (8) is in the axial direction of the set of discs substantially shorter than the length of the part (A) of the key way of the lock corresponding to said locking disc (4) and located asymmetrically with regard to the locking disc (4) in the axial direction in such a way that turning of said locking disc (4) in the set of discs around an axis in the plane of said disc causes the location of the corresponding combination surface (14) of the key (8) on the key blade to be changed.

11 Claims, 9 Drawing Figures

CYLINDER LOCK

The invention relates to a cylinder lock.

BACKGROUND OF THE INVENTION

One kind of cylinder lock includes a locking member, a set of locking discs arranged in succession, and intermediate discs sseparating the locking discs from each other. Each locking disc is provided both with a peripheral notch and with a key opening that is bounded by a key-engaging surface of the disc. The key openings jointly form a keyway into which a key for the lock can be inserted, and the locking discs are turnable by engagement of combination surfaces of the key with the key-engaging surfaces of the locking discs to a position in which the peripheral notches are arranged in line forming a channel into which the locking member is able to move so that the whole set of discs is released from locking engagement of the locking member and is able to turn, allowing force transmission from the key in a desired manner.

The key has a blade or shank, and in the context of this type of lock the pitch of a key is the mutual positioning of the combination surfaces in the axial direction of the key blade. With regard to preventing picking of the lock it is important that the pitch of the key cannot, at least not easily, be directly detected through the key way from the lock cylinder. On the other hand by changing the pitch of the key the number of different opening variations available can naturally be increased remarkably.

One way of changing the pitch of a key is to use locking discs and intermediate discs of different thickness in the same set of discs of the lock, whereby the pitch of the key can be changed by changing the mutual positions of discs of different thickness in the set of discs. A disadvantage of this solution is the necessity of making discs of different thickness which increases the number of items to be stored. Additionally, using discs of different thickness in the same filling of a cylinder lock is inconvenient with regard to automation of the assembling procedure.

An object of the invention is to provide a simple solution for alteration of the pitch of the key of the lock so that the number of opening variations can be increased and, at the same time, picking of the lock can be made more difficult. A further object is to make the solution favorable with regard to production technology and to avoid making the construction of the lock more complicated.

SUMMARY OF THE INVENTION

A preferred cylinder lock embodying the invention includes a number of locking discs each having two substantially parallel opposite end faces and provided with a key opening. The locking discs are arranged in a stack having a predetermined axial length so that a keyway for receiving a key is formed jointly by the key openings. The locking discs are turnable by means of combination surfaces of the key to a predetermined angular position. At least one of the locking discs has a key-engaging surface that is substantially shorter in the axial direction of the stack than the distance between the two opposite end faces of the disc and is located asymmetrically with respect to a plane of the locking disc that lies midway between and parallel to the two opposite end faces of the disc. The location of the key-engaging surface of this particular locking disc relative to the other locking discs of the stack can be changed without affecting the length of the stack by reversing the orientation of that locking disc in the stack of discs. In the preferred embodiment of the invention, therefore, there is no need for several different locking discs possibly of special construction nor other special arrangements relating to the construction of the lock. Only one type of locking disc need be used, whereby the pitch of a key is determined simply by the way in which the locking disc is placed in the set of discs of the lock.

Preferably, the locking discs are dimensioned and formed so that the periphery of the locking disc remains in its position in the axial direction of the set of discs regardless of the way in which the locking disc is placed in the set of discs. In one embodiment the locking disc is provided with an axial stepping on the side of the key opening, in other words on the central part of the disc, so that the locking disc has a cup-like form. In principle still greater a change in the pitch of the key can be achieved when turning the locking discs around an axis in the plane of the discs in accordance with the invention if the peripheral surface of the locking disc is provided with an axial stepping as well. This stepping is made on the other side of the locking disc than the stepping of the key opening. Said stepping in the peripheral surface of the locking disc is in the axial direction most preferably less than half of the total thickness of an intermediate disc so that the locking disc having been turned around in the sense of the invention is not in contact with the adjacent locking disc. It is advisable to make a depression in the lock cylinder for the stepping of the outermost locking disc of the set of discs so that also the outermost locking disc of this kind can be placed in the set of discs in either way without changing the position of the set of discs with regard to the lock cylinder in the axial direction.

BRIEF DESCRIPTION OF THE DRAWINGS

In the following the invention is described more in detail with reference to the attached drawing, in which.

DETAILED DESCRIPTION

Figure 1:
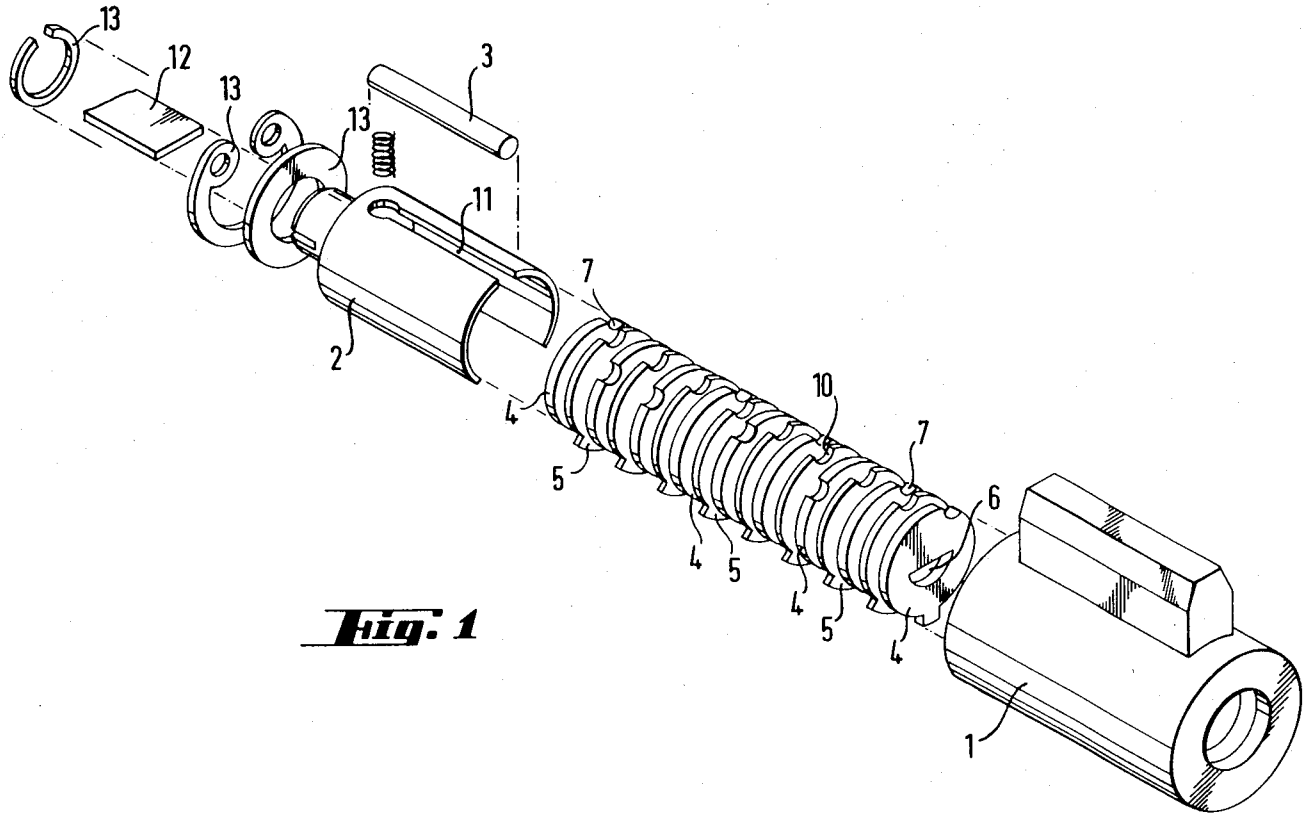
FIG. 1 shows an assembly illustration of the type of cylinder lock with rotary locking discs to which the invention is directed.

In the drawing the reference numeral 1 refers to a cylinder housing, enclosing a cylinder 2, a locking bar 3 and a set of discs comprising locking discs 4 and intermediate discs 5. The locking discs include a key opening 6 and a peripheral notch 7, the location of which on the periphery determines the amount of rotation for each locking disc needed to open the lock. Also the intermediate discs include a peripheral notch 10 and an opening 9 permitting insertion of the key therethrough.

When the lock is locked the locking bar 3 prevents cylinder 2 from being turned with regard to the cylinder housing 1. When turning the locking discs 4 with the key 8 of the lock their peripheral notches 7 take the position of a slot 11 in the cylinder 2 and of the locking bar 3 forming, together with the peripheral notches 10 of the intermediate discs, a uniform channel into which the locking bar moves. Hereby, at the same time, the locking bar 3 releases the cylinder 2 and the whole set of discs to turn further so that force can be transmitted from the key as desired, for example to the bolt of a door. For this purpose the end of the cylinder 2 can be formed in a suitable manner and, for example, be provided with a force transmission element 12, the attachment of which can be arranged by means of elements 13.

According to the invention, at least some of the locking discs 4 of the lock are formed so that a surface 6*a* of the key opening 6 of the locking disc co-operating with the corresponding combination surface of the key (cf. surfaces 14*a, b* and *c*) is in the axial direction of the set of discs substantially shorter than the total thickness A of the locking disc 4, defined between the two opposite end faces 18 and 20 of the disc. Herein the total thickness A indicates also expressly the length of that part of the key way, formed jointly by the discs of the set of discs, which is at the position of said locking disc. As the surface 6*a* is located on one edge of the key opening 6 in the axial direction of said disc as well as of the whole set of discs, turning of the locking disc in the other way in the set of discs in accordance with the invention results in a shift or displacement of the location of the corresponding combination surface of the key. This makes the old key inoperable and, thus, a new key has to be cut having a proper location for its combination surfaces corresponding to said repositioning in the axial direction of said surface 6*a* of the locking disc.

Figure 3A:
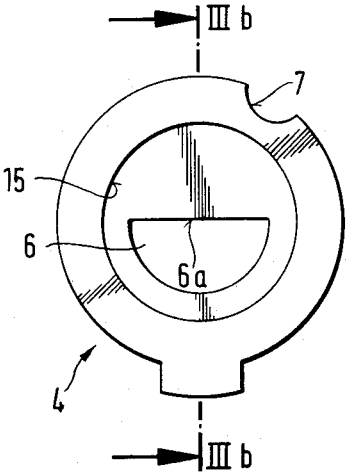
FIGS. 3*a* and 3*b* show another embodiment of the locking discs of a cylinder lock according to the invention.
Figure 3B:
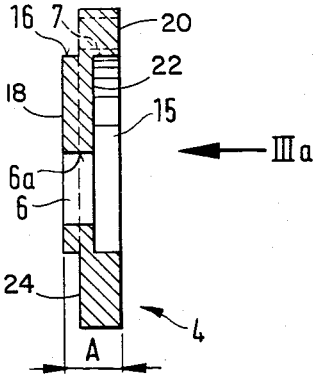
Figure 5:
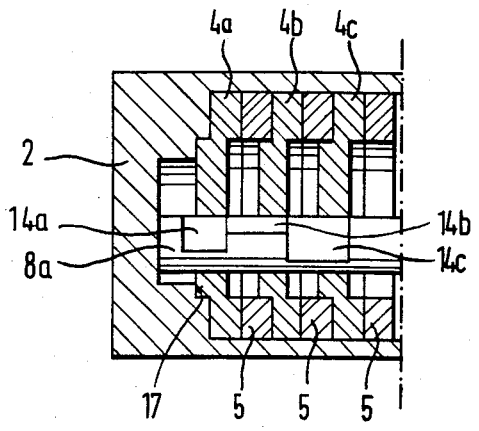
FIGS. 5–7 show the principles of changing the pitch of the key by utilizing the invention.
Figure 6:
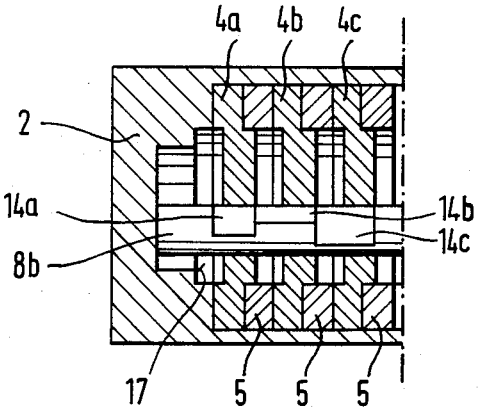
Figure 7:
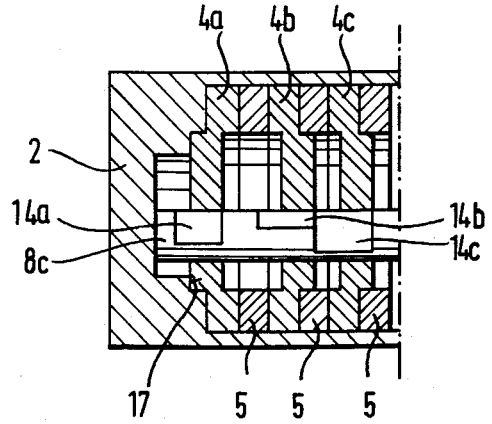

Changing of the pitch of a key in accordance with the invention is illustrated in FIGS. 5–7, which are based on the embodiment of locking disc according to FIGS. 3*a* and 3*b*. In FIG. 5 the locking discs 4*a*, 4*b* and 4*c* are all in the same way in the set of discs of the lock. The combination surfaces 14*a*, 14*b* and 14*c* cut in the key 8 correspond to these locking discs. FIG. 6 shows one possibility of changing the pitch of the key. In this case said locking discs 4*a*, 4*b* and 4*c* have all been turned around whereby their surfaces 6*a* have shifted at the same time axially or in the direction of the key and the key way. Because of this also the position of the corresponding combination surfaces of the key has changed so that neither the pitch of the key 8*a* of FIG. 5 fits the lock of FIG. 6 nor the pitch of the key of FIG. 6 fits the lock of FIG. 5, respectively.

As for the case of FIG. 7 only the locking discs 4*b* and 4*c* have been turned around with regard to the starting situation of FIG. 5, whereby, again, a new pitch for the key has been accomplished, the corresponding lock of which cannot be opened with the keys 8*a* and 8*b* according to the FIGS. 5 and 6.

Figure 2A:
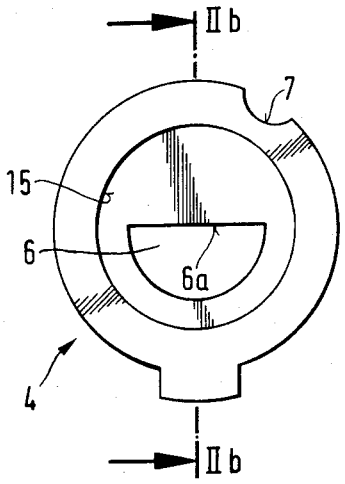
FIGS. 2*a* and 2*b* show one embodiment of the locking disc of a cylinder lock according to the invention.
Figure 2B:
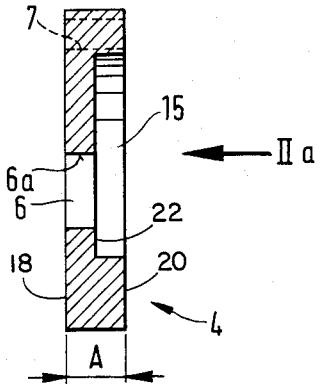
Figure 4:
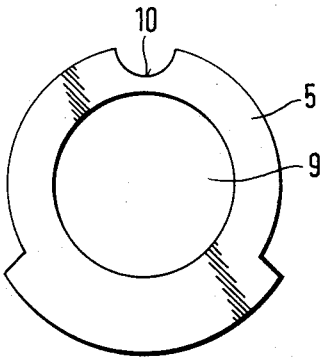
FIG. 4 shows an intermediate disc of a cylinder lock.

Each locking disc has an annular peripheral region in which the notch 7 is formed and an inner region in which the key opening 6 is formed. In practice the locking discs 4 are designed so that their key opening 6 is provided with an axial stepping 15 such that the inner region is defined between the end face 18 and a surface 22 that lies between the faces 18 and 20. In the embodiment shown in FIGS. 2*a* and 2*b* the peripheral region is defined between the end faces 18 and 20, and the length and the position of the set of discs in cylinder 2 remain completely unchanged irrespective of the way in which the locking discs of the set of discs are positioned. There is no need to make any changes in the construction of the lock when using locking discs according to FIGS. 2*a* and 2*b* but all the elements of the lock can be standard components as is the case for example with the intermediate disc shown in FIG. 4.

Also the peripheral surfaces of the locking discs can be provided with an axial stepping 16, as shown in FIG. 3*b*, which stepping decreases the thickness of the peripheral region of the locking disc. The peripheral region of the disc is defined between the end face 20 and a surface 24 that lies between the end face 18 and the surface 22. When the stepping 16 is in the axial direction less than half of the total thickness of an intermediate disc and when the cylinder 2 is provided with a depression 17 for the stepping 16 (FIG. 6), all the locking discs in the set of discs, i.e. also the outermost ones, can be turned around without displacement of their peripheral regions in the axial direction of the cylinder 2.

In order to be turnable the construction of the locking discs of the set of discs needs to be symmetric. As peripheral notches 7 of the locking discs are cut on a region extending at both sides of the axis of symmetry (in FIGS. 2*a* and 3*a* the cross-sectional line), the position of the peripheral notch 7 and thus the size of the cut for the corresponding combination surface of the key are changed as in a reflected image when the locking disc is turned around said axis of symmetry in accordance with the invention. Thus, for example, the so called cut 0 becomes cut 5, cut 1 becomes cut 4 and cut 2 becomes cut 3 if the cuts vary from an uncut combination surface (=cut 0) to the complete 90° cut (=cut 5)in the key blade.

It is pointed out that the application of the invention does not at all depend on the form of the key opening 6 of the locking discs nor, consequently, on the form of the profile of the key blade either, but numerous other forms for the key opening 6 can be used. It is essential that the locking disc can be turned by the key to a position opening the lock. On the other hand the key opening 6 need not necessarily include such a counter surface by means of which the locking disc can directly be returned to the datum position, but other solutions suitable for the purpose can be used as well, e.g. as is disclosed in the U.S. Pat. No. 4,351,172, according to which returning of the locking discs is accomplished by means of a transmission member turning with the key and return bars.

The invention is not limited to the embodiments shown, but several modifications thereof are feasible within the scope of the attached claims.

What is claimed is:

1. A cylinder lock including a number of locking discs each having two substantially parallel opposite end faces and provided with a key opening, the locking discs being arranged in a stack having a predetermined axial length so that a keyway for receiving a key is formed jointly by the key openings, whereby the locking discs are turnable by means of combination surfaces of the key to a predetermined angular position, and at least one of the locking discs having a key-engaging surface that is substantially shorter in the axial direction of the stack than the distance between the two opposite end faces of the disc and is located asymmetrically with respect to a plane of the locking disc that lies midway between and parallel to the two opposite end faces of the disc, so that the location of the key-engaging surface of said one disc relative to other discs of the stack can be changed without affecting the length of the stack by reversing the orientation of said one locking disc in the stack of discs.

2. A cylinder lock according to claim 1, comprising a plurality of intermediate discs that separate the locking discs from each other in the stack, each intermediate disc being annular in form and defining a central aperture, and wherein said one locking disc has an outer annular region that is disposed between two adjacent intermediate discs and an inner region in which the key opening is formed and which projects axially of the stack beyond the annular region and extends into the central aperture of one of the intermediate discs by an amount that is less than the axial thickness of the intermediate disc.

3. A method of modifying a cylinder lock that includes a number of locking discs each having two substantially parallel opposite end faces and provided with a key opening, the locking discs being arranged in a stack so that a keyway for receiving a key is formed jointly by the key openings, whereby the locking discs are turnable by means of combination surfaces of the key to a predetermined angular position, and at least one of the locking discs having a key-engaging surface that is substantially shorter in the axial direction of the stack than the distance between the two opposite end faces of the disc and is located asymmetrically with respect to a plane of the locking disc that lies midway between and parallel to the two opposite end faces of the disc, said method comprising reversing the orientation of said one locking disc in the stack of discs, whereby the location of the key-engaging surface of said one disc is changed.

4. Locking apparatus comprising a cylinder lock and a key, the key having an elongate blade with a plurality of combination surfaces distributed therealong, and the lock including a number of locking discs each having two substantially parallel opposite end faces and provided with a key opening, the locking discs being arranged in a stack having a predetermined axial length so that a keyway for receiving the key is formed jointly by the key openings, whereby the locking discs are turnable by means of the combination surfaces of the key to a predetermined angular position, and at least one of the locking discs having a key engaging surface that is substantially shorter in the axial direction of the stack than the distance between the two opposite end faces of the disc and is located asymmetrically with respect to a plane of the locking disc that lies midway between and parallel to the two opposite end faces of the disc, so that the location of the key-engaging surface of said one disc relative to other discs of the stack can be changed without affecting the length of the stack by reversing the orientation of said one locking disc in the stack of discs.

5. A cylinder lock including a locking member, a set of locking discs arranged in succession, and intermediate discs separating the locking discs from each other, each locking disc being provided both with a peripheral notch and with a key opening that is bounded by a key-engaging surface of the locking disc, such that a key for the lock is insertable into a keyway formed jointly by the key openings, whereby the locking discs are turnable by engagement of combination surfaces of the key with the key-engaging surfaces of the locking discs to a position in which the peripheral notches are arranged in line forming a channel into which the locking member is arranged to move so that the whole set of discs is released from the locking engagement of the locking member and is able to turn allowing force transmission from the key in a desired manner, the peripheral notch of at least one locking disc being arranged so that said one locking disc is placeable in the set of discs selectively in either of two possible orientations, and the key-engaging surface of said one locking disc being substantially shorter in the axial direction of the set of discs than the length of the part of the keyway of the lock that is formed by said one locking disc and being located asymmetrically with regard to the axial direction so that the location of the key-engaging surface is changed when the orientation of said one locking disc in the set of discs is changed.

6. A cylinder lock according to claim 5, wherein said locking discs are dimensioned and formed so that the periphery of said one locking disc is in the same position with respect to the axial direction regardless of the orientation of said one locking disc in the set of discs.

7. A cylinder lock according to claim 6, wherein said one locking disc has an outer annular region in which the notch is formed and an inner region in which the key opening is formed, and the length of the outer region in the axial direction is greater than the length of the inner region in the axial direction.

8. A cylinder lock according to claim 7, wherein the inner and outer regions of said one locking disc are each defined between first and second opposite surfaces, the first surface of the inner region being coplanar with the first surface of the outer region, and the first surfaces of the inner and outer regions together constituting one of two opposite end faces of the locking disc, and the second surface of the outer region constituting the other of the two opposite end faces of the locking disc.

9. A cylinder lock according to claim 7, wherein the inner and outer regions of said one locking disc are each defined between first and second opposite surfaces, the first surface of the inner region constituting one of two opposite end faces of the locking disc and the first surface of the outer region constituting the other of the two opposite end faces of the locking disc, the second surface of the inner region being intermediate the first and second surfaces of the outer region and the second surface of the outer region being intermediate the first and second surfaces of the inner region.

10. A cylinder lock according to claim 9, wherein the intermediate discs are all of the same thickness and the distance between the plane of the first surface of the inner region and the plane of the second surface of the outer region is less than half of the thickness of an intermediate disc.

11. A cylinder lock according to claim 9, wherein the keyway has an outer end at which the key is inserted into and withdrawn from the keyway, and an inner end, and said one locking disc is located at an end of the set of discs and the lock also comprises a cylinder element that defines a cylindrical cavity and has an end wall that defines the inner end of the keyway, the set of discs being located in the cylindrical cavity with said one locking disc presented towards the end wall of the cylinder element, said end wall being formed with a recess of which the diameter is larger than the external diameter of said inner region and of a depth that is at least equal to the distance between the plane of the first surface of the inner region and the plane of the second surface of the outer region.

* * * * *